US006070641A

United States Patent [19]

Budetti

[11] Patent Number: 6,070,641

[45] Date of Patent: Jun. 6, 2000

[54] FAILSAFE AUTOMATIC BRAKING MECHANISM FOR A ROLLING DOOR SYSTEM

[76] Inventor: Fred Budetti, 184 S. Park Dr., Massapequa Park, N.Y. 11762

[21] Appl. No.: 09/225,634

[22] Filed: Jan. 5, 1999

[51] Int. Cl.[7] ..... E06B 9/80

[52] U.S. Cl. ..... 160/302; 49/322; 74/411.5

[58] Field of Search ..... 160/310, 291, 160/300, 302, 303, 1, 2, 4, 6, 8, 9; 74/411.5, 526, 575, 577 R, 577 S; 49/322

[56] References Cited

U.S. PATENT DOCUMENTS 4,704,914 11/1987 Horng ..... 160/300 X
5,706,552 1/1998 Hsieh ..... 49/322 X

*Primary Examiner*—David M. Purol
*Attorney, Agent, or Firm*—Lackenbach Siegel Marzullo Aronson & Greenspan, P.C.

[57] ABSTRACT

An automatically braking mechanism for a rolling door system is used in connection with en elongate support shaft for selectively rolling up or lowering the rolling door formed of a series of connected slats. A driven wheel is fixed on the support shaft and a motor drive is provided for driving a chain drive sprocket wheel and a continuous roller chain couples the drive and driven sprocket wheels. The roller chain normally moves along a predetermined path prior to failure of the roller chain when the roller chain is under tension. A braking mechanism includes a first elongate sensing arm pivotally mounted at one end and carries a follower roller at the other end which is normally in direct contact wit the roller chain. A second elongate actuator arm is integrally formed with the sensing arm so as to be pivotally mounted for sharing common angular movements with the sensing arm. A stop pin is mounted on the actuator arm for sharing movements with the actuator arm and for movements between a normal mode disengaged position in which the stop pin clears the driven sprocket wheel to permit rotation thereof when the follower roller engages the roller chain while the roller chain is under tension. The actuator arm and stop pin move to a failure mode engaged position in which the stop pin engages the driven sprocket wheel to prevent rotation thereof when the follower roller bridges or crosses the predetermined path of the roller chain. A tension spring normally urges the actuator arm to move to the failure position when permitted to do so by the sensing arm. In this way the roller chain maintains the actuator arm in the normal mode position prior to failure of the roller chain.

21 Claims, 3 Drawing Sheets

FAILSAFE AUTOMATIC BRAKING MECHANISM FOR A ROLLING DOOR SYSTEM

BACKGROUND OF THE INVENTION

1. Field of the Invention

The present invention generally relates to rolling door control apparatus, and more specifically to a failsafe automatic braking mechanism for a rolling door.

2. Description of the Prior Art

Numerous types of rolling doors have long be used particularly in commercial and industrial buildings. The general constructions and operations of such rolling doors are well known to those skilled in the art. Basically such rolling doors consist of a curtain of articulated slats that can be raised or lowered to selectively open and close a doorway or other opening in the building. The curtain is rolled and unrolled from a roll cylinder which is typically mounted horizontally across the top of the doorway. The roll cylinder is typically coupled to a drive for rotating the cylinder about its axis by means of a driven wheel coupled to the roll cylinder, a drive wheel mounted on a support shaft of a drive motor and a continuous loop drive which couples the drive and driven wheels. Most frequently the drive and driven wheels are chain drive sprocket wheels and the loop drive is a roller chain.

A major hazard that rolling doors present, however, is that potentially they can cause injury to operating personnel and/or damage by uncontrollably dropping due to failure of the system. Rolling doors can be quite heavy and although are typically provided with compensating systems to counterbalance the weight thereof such counterbalancing systems can and do fail. Such failures may result for many reasons including the braking of a counterbalance spring, a broken roller chain or power failure or reduction of voltage to the electric motor. When any of the aforementioned or other possible problems occur the door may be released in such a fashion that it undergoes free fail. As such rolling doors are frequently constructed of relatively heavy materials there is the possibility of extensive damage to the door slats or other slats or other system components and of course damage to property or injury to personnel located in or proximate to the door opening at the time of such free fall.

Due to the possibility of component or power failure, and to the fact that resultant free fall consequences have been known in the industry for some time, numerous efforts have been made to develop different types of stop mechanisms for rolling doors in the event of such anticipated failures. In some instances the stop mechanisms tend to be complex and, to that extent, tend to be less reliable since the stop mechanisms themselves can fail.

For example in U.S. Pat. No. 4,848,522 a safety device to prevent accidental unwinding of a rolling shutter or rolling overhead door is disclosed. The safety device includes a cog wheel which has uniformly distributed on the circumference opening radially movable tumblers. A cage surrounds the cog wheel that contains an abutment in the form of a recess for the tumblers that are raised by the action of centrifugal force. Upon reaching a predetermined rotational speed the tumblers engage an abutment in the cage and the cage, acting as a brake, is then driven by the cog wheel and slowed down by friction. However, such safety device is expensive and not extremely reliable. Also, by the nature of the mechanism the inertia of the components results in a time delay before a predetermined rotational speed is achieved. As the device is inherently slow considerable damage and/or injury may result before the desired braking action is achieved. Additionally the device has been known to jam at times at slow speeds which can cause damage to the drive motor.

In U.S. Pat. No. 4,112,996 a safety device is disclosed for arresting unrolling of a roller blind which is in some respects similar to the aforementioned patent in which an inertial member supported relatively movably with respect to a block shaft requires an increased unrolling velocity to cause the inertial member to change its relative movement and activate a gate member to release a pawl to permit it to engage the teeth of the gear and arrest unrolling. See also U.S. Pat. No. 5,494,093 which disclosed a rolling door stop apparatus in which a stop dog mounted on a pivot for rotation thereon is responsive to centrifugal forces created by rotation of rotor.

In U.S. Pat. No. 4,704,914 a chain breakdown safety device for a power-driven roller door is disclosed. In this device a steering rod is arranged on both sides of a chain between the sprocket and the chain wheel. A elongate movable rod is disposed typically perpendicularly to a line extending between the centers of the sprockets and the chain wheel respectively, the movable rod having a pair of slots formed therein for receiving the steering rod and a toothed rack portion. An idler roller is mounted on the movable rod for engaging a portion of the chain. Springs apply bias to the movable rod and the roller against the chain and a ratchet arrangement is provided for engaging with a toothed rack portion of the rod for causing a first engaging tooth to engage the toothed chain wheel when the movable rod shifts. In this manner the unrolling of the roller door is intended to be prevented should the chain fail. This arrangement is relatively complex and relies on a plurality of cooperating components to arrest the falling of the roller door. The stresses due to the momentum of force of rotation of the chain wheel can be significant, according to the disclosure, that a second engaging tooth needs to be used almost instantaneously to arrest the motion of the chain wheel.

In U.S. Pat. No. 3,704,757 an automatically braking mechanism is disclosed which includes a pivotally mounted brake arm having sprocket teeth engaging means movable into and out of engagement with the sprocket teeth of each chain drive sprocket wheel by means of a toggle linkage which when collapsed by the an air cylinder that moves the brake arm out of engagement and, when moved slightly past a dead center position by the air cylinder, moves the brake arm into engagement under the assistance of a torsion spring. This device does not directly monitor the integrity of the roller chain. Instead an air cylinder is relied upon to create the necessary air pressure, presumably once the door enters a free fall condition. Again, such an arrangement is unsatisfactory as it requires air pressure to build up and this may reflect an unacceptable delay before the toggle linkage actuates the brake arm.

SUMMARY OF THE INVENTION

Accordingly an object of the present invention is to provide an automatic braking mechanism for a rolling door system which does not have the disadvantages of the comparable prior art systems.

It is another object of the present invention to provide an automatic braking mechanism of the type aforementioned which is simple in construction and economical to manufacture.

It is still another other of the present invention to provide an automatic braking system of the type under discussion which is substantially failsafe as it has virtually no elements that can fail.

It is yet another object of the present invention to provide an automatic braking system for a rolling door system which is extremely fast acting and is almost instantaneously responsive to a failure of a roller chain.

It is a further object of the present invention to provide an automatic braking mechanism as in the previous objects which reliably secures a rolling door again free fall once the braking mechanism has been activated.

It is an additional object of the present invention to provide an automatically braking mechanism that can be used with a wide variety of rolling doors.

In order to achieve the above objects as well as other which will become apparent hereafter an automatic braking mechanism for a rolling door system, having an elongate support shaft for selectively rolling up or lowering a rolling down formed in a series of connected slats a driven wheel fixed on the support shaft, a motor drive for driving a drive wheel and a continuous loop coupling said drive and driven wheels and normally moving along a predetermined path prior to failure when said loop drive is under tension in a drive plane generally normal to said support shaft, comprises a first elongate sensing arm pivotally mounted at one end and carrying a follower at the other end normally in direct contact with said loop drive. Said sensing arm is movable in a plane substantially parallel with said drive plane to substantially arrange said follower in said drive plane the movement from one side of said predetermined path to at least partially bridge or cross said predetermined path to the other side thereof, a second elongate actuator arm is pivotally mounted for sharing common angular movements with said sensing arm. Stop means is provided on said actuator arm for sharing movements with said actuator arm and for movements between a normal mode disengaged position in which said stop means clears said driven wheel to permit rotation thereof once its follower engages said loop drive while said loop drive is under tension, and a failure mode engaged position in which said stop means engages said driven wheel to prevent rotation thereof once its follower bridges or crosses over said predetermined path. Biasing means is provided for normally urging said actuator arm to move to said failure mode position. In this way said loop drive maintains said actuator arm in said normal mode position prior to failure of said loop drive.

BRIEF DESCRIPTION OF THE DRAWINGS

Other aspects, objects and advantages of the present invention will become apparent upon reading of the following detailed description of the preferred embodiment of the present invention when taken in conjunction with the drawing, as follows.

DESCRIPTION OF THE PREFERRED EMBODIMENTS

Figure 1:
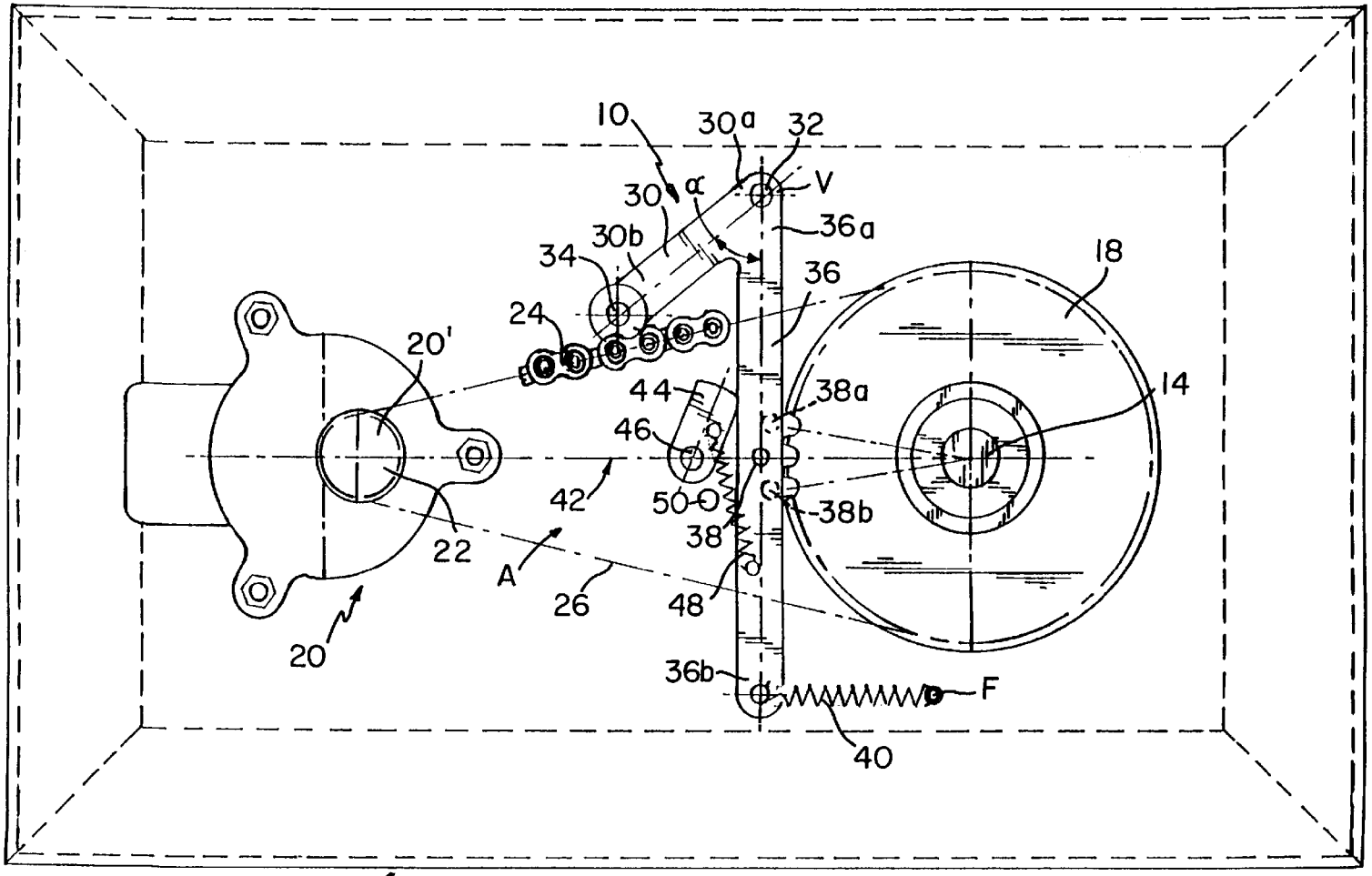
FIG. 1 is a diagrammatic view of an automatic braking mechanism for rolling door systems in accordance with the present invention, shown when the drive roller chain is under tension prior to failure with the pivotally mounted brake mechanism disengaged form the driven chain drive sprocket wheel.
Figure 3:
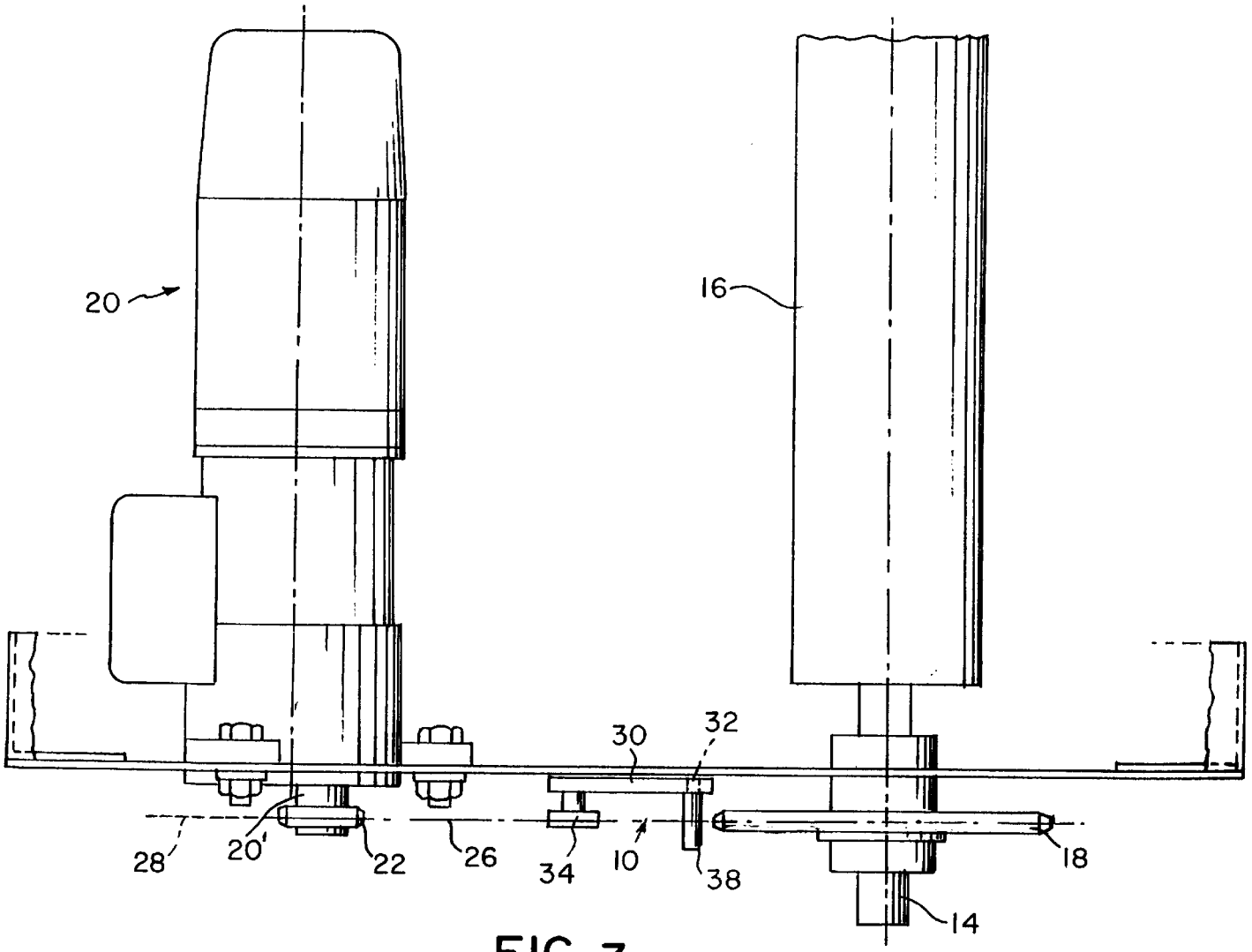
FIG. 3 is a top plan view of the automatic braking mechanism shown in FIG. 1 prior to failure of the roller chain.

Referring now specifically to the Figures in which identical or similar parts are designated by the same reference numbers throughout and first referring to FIGS. 1 and 3 an automatic braking mechanism for a rolling door system in accordance with the present invention is generally designated by the reference numeral 10.

The braking mechanism of the present invention will be described in conjunction with a typical or conventional rolling door system generally designated by the reference numeral 12 which has an elongate support shaft 14 attached to a roll cylinder 16 (FIG. 3) for selectively rolling up or lowering a rolling door formed of a series of connected slates (not shown). A driven chain drive sprocket wheel 18 is fixed on the support shaft 14. A motor drive 20 is generally spaced from the support shaft 14 for driving a drive sprocket wheel 22. A loop drive coupling 24 is typically provided which mechanically couples the drive and driven wheels 22, 18 and normally moves along a predetermined path 26 shown in phantom outline (FIG. 1) prior to failure of the loop drive when the loop drive is under tension. As shown, a drive shaft 20' of the motor 20 and the drive shaft 14 attached to the roll cylinder 16 are generally parallel to each other and both normal to a plane or surface 28 (FIG. 3) which passes through the drive and driven wheels. The loop drive is generally arranged in the plane 28.

While any mechanical drive may be used it will also be clear that the any loop drive may be used such as belts, roller chains, etc. Of course the loop drive must correspond to the engaging members or features on the drive and driven wheels. In the example being described the drive and driven wheels 22, 18 are in the form of chain drive sprocket wheels or toothed chain drive wheels and the loop drive is in the form of a conventional roller chain typically used for operating rolling door opening and closing apparatus.

The braking mechanism 10 in accordance with the present invention, initially referring to FIG. 1, comprises a first elongate sensing arm 30 pivotally mounted at one end 30*a*by means of a transverse pivot pin 32 carries a follower 34 at the other end 30*b*. As shown in FIG. 1 the follower in the embodiment being described is in the form of a roller that is normally in direct contact with the roller chain 24. The sensing arm 30 is movable within a plane substantially parallel with the drive plane 28 to substantially arrange the follower roller 34 in the drive plane for movements from one side of the predetermined path 26 (shown above the path in FIG. 1) when in contact with the roller chain 24 to continuously engage the roller chain. The sensing arm 30 can, however, move to at lest partially bridge or cross over the predetermined path 26 to the other side thereof as suggested in FIG. 2 upon failure of the roller chain 24. It will be noted, however, that the total amount of angular movement of the sensing arm 30 about the pivot 32 is relatively small in all anticipated positions thereof.

A second elongate actuator arm 36 is likewise pivotally mounted about the pivot pin 32 for sharing common angular movements with the sensing arm 30. In the presently preferred embodiment the sensing and actuator arms 30, 36 are integrally formed as one pivotally mounted unit. However it will be evident to those skilled in the art that the same benefits, features and advantages of the present invention can be obtained when the sensing and actuator arms 30, 36 are separate components when mounted or arranged so that they share common angular or pivotal movements.

Stop means fin the form of a transverse stop pin 38 is mounted on the actuator arm 36 for sharing movements with the actuator arm and for movements between a normal mode disengaged position (shown in FIG. 1) in which the stop pin 38 clears the driven sprocket wheel 18 to permit rotation thereof when the follower roller 34 engages the roller chain 24 while the roller chain is under tension. However failure of the roller chain, as suggested in FIG. 2, causes the actuator arm 36 to move to a failure mode engaged position in which the stop pin 38 engages the sprockets or teeth on the driven sprocket wheel 18 to prevent rotation thereof when the follower roller at least partially bridges or crosses the predetermined path 26.

Figure 2:
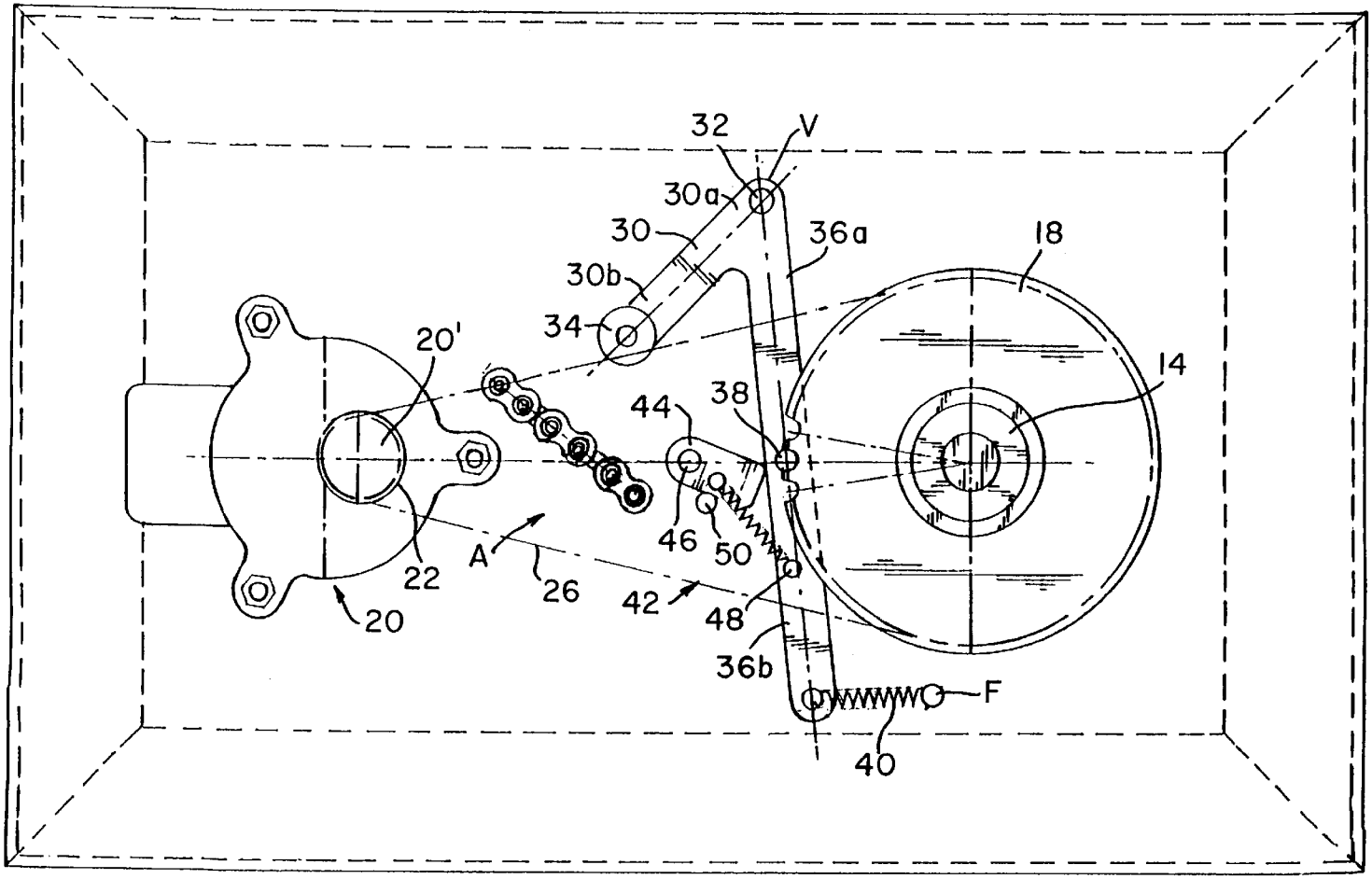
FIG. 2 is similar to FIG. 1 but showing the roller chain drive following failure in which the pivotally mounted brake mechanism is released by the chain and a stop pin on an actuator arm is caused to engage the sprockets or teeth of the driven sprocket wheel and the actuator arm is locked in the sprocket wheel engaging position to prevent it from inadvertently disengaging the sprocket wheel to thereby reliably lock the support shaft on which the following door is wound.

As shown in FIGS. 1 and 2 biasing means is provided for normally urging the actuator arm 36 to move to the failure locking position by pulling the actuator lever as shown to rotate the latter in a counterclockwise direction, as viewed in FIGS. 1 and 2. In the embodiment being described such biasing means is in the form of tension spring 40 which extends between the remote end 36*b* of the actuating arm and a fixed reference point F. It will be clear therefore that the roller chain 24 normally maintains the sensing arm 30 elevated when the follower roller 34 rides on the roller chain 24 in the normal position prior to failure of the roller chain, being prevented from pivoting in a counterclockwise direction by the tensioned roller chain.

The specific configuration of the brake arm of the invention is not critical and different shapes of such arm may be used. In the embodiment shown the sensing and actuator arms 30, 36 are joined at a vertex V at which the arms are pivotally mounted on the pivot pin 32. As indicated the arms 30, 36 define an angle $\alpha$ therebetween at such vertex. The predetermined path 26 of the roller chain 24 defines an enclosed region A prior to failure of the roller chain. As shown the arms 30, 36 are pivoted at a point outside of the enclosed region A. With such an arrangement the angle $\alpha$ is preferably less than 90°. However when the arms are pivoted at a point inside the enclosed region A the angle $\alpha$ may be greater than 90°.

As best shown in FIGS. 1 and 3 one transverse pin 38 is mounted on the actuator arm 36 along a direction substantially parallel to the support shaft 14. The transverse stop pin 38 is dimensioned to be received between two adjacent sprockets or teeth of the driven sprocket wheel 18. Although one stop pin 38 is shown in solid outline additional stop pins 38*a*, 38*b* are shown in phantom outline to indicate that more than one stop pin may be used. When more than one such pin is used they are preferably arranged along an arc corresponding to the curvature of the driven sprocket wheel 18 so that when the actuator arm 36 is moved to the engaging position all of the stop pins 38, 38*a*, 38*b* are equally and fully received within associated sprockets or teeth. Clearly the provision of two or more stop pins distributes the forces or stresses on each of the pins and renders the mechanism longer lasting and more reliable.

As best shown in FIGS. 1 and 3 the stop pin 38 is mounted on the actuator arm 36 at a position intermediate the pivoted end 36*a*and the opposing free end 36*b* to which the tension spring 40 is attached. By attaching the tension spring 40 at the remote end 36*b* of the actuator arm the restoring torques on the actuator arm 36 are maximized to restore the same to the failure mode engaged position upon failure of the roller chain 24.

An important feature of the present invention is that the distance between the pivoted end 30*a* of the sensing arm 30 and the follower 34 normally engaged with the roller chain 24 is generally smaller than the distance between the pivoted end 36*a* of the actuator arm and the intermediate position of the stop pin 38. Thus, if the distance between the pivot pin 32 and the roller 34 is $d_1$ and the distance between the pivot pin 32 and the position of the stop pin 38 is $d_2$ it is preferable that $d_1 \neq d_2$. In fact to optimize the benefits of the present invention the distance $d_2$ is preferably greater than $d_1$, in order to magnify or amplify the movements of the follower roller 34. Because the sensing arm 30 and the actuator arm 36 are integrally formed and share common angular pivoting or rotational movements about the pivot pin 32 the angular movements by the roller 34 and the stop pin 38 are directly proportional to the distances that each of these elements assumes from the pivot pin 32. Therefore if $d_2/d_1=2$ inches an angular movement of the follower roller 34 of approximately one inch or arc will result in a movement of the stop pin 38 in an arc of approximately 2 inches. Therefore it should be clear that the movement of the stop pin 38 is effectively accelerated and even slight or small movements of the follower roller 34 will result in more amplified travel by the stop pin 38. Such arrangement therefore renders the braking mechanism sensitive to the condition of the roller chain 24. As soon as the roller chain 24 fails even a very small counterclockwise movement of the sensing arm 30 causes the actuator arm 36 to rotate sufficiently in a counterclockwise direction to almost immediately engage the driven sprocket wheel 18. It is preferred therefore that $d_2/d_1 \geqq 1.25$. In the embodiment shown $d_2/d_1 \approx 1.40$.

Referring to FIG. 1 a retaining member 42 is preferably provided for retaining the stop pin 38 in locking engagement with the driven sprocket wheel 18 after the roller chain 24 has failed to ensure that the driven wheel 18 cannot inadvertently rotate following failure and initial engagement with the stop pin 38. Such a retaining device is shown in FIG. 1 as consisting of a pawl 44 pivotally mounted on a pin 46 mounted proximate to the actuator arm 36 and maintained by the actuator arm in a non-operative position against the action of a biasing spring 48. A stop pin 50 is provided for limiting movement of the pawl 44 beyond a dead center position under the action of the spring 48 when the actuator arm 36 has moved into engagement with the driven sprocket wheel 18 at which time the pawl 44 abuts against the actuator arm 36 and prevents further pivotal movements therefore. This is best illustrated in FIG. 2 where the pawl 44 has been shown to have been rotated by the tension spring 48 one end of which is secured to the actuator arm 36 and the other end to the pawl itself. The radical dimensions of the pawl 44 are such so that once the actuator arm 36 has been pivoted to its counterclockwise-most position as shown in FIG. 2, after the stop pin 38 has been received within the sprockets or teeth of the driven wheel 18 the pawl 44 can rotate in a clockwise direction beyond its dead center position up to the point where it abuts against the stop or limit pin 50. Being beyond its dead center position the pawl 44 cannot rotate in a counterclockwise direction about the pivot pin 46 and cannot rotate in a further clockwise direction due to the stop pin 50. The position of the pawl 44 is effectively locked against all further movements. Since it abuts against the actuator arm 36 in this condition while the stop pin 38 is engaged with the driven sprocket wheel 18 the stop pin 38, or stop pins 38, 38*a*, 38*b*, if a plurality of such pins are provided continue to engage the driven sprocket wheel 18 and cannot inadvertently be withdrawn therefrom. This assures that once the follower roller 34 is permitted to move even slightly in a counterclockwise direction such rotation or pivoting is almost immediately translated into a locking of the driven sprocket wheel 18 and locking of the actuator arm 36 in such position that will continue to lock the driven sprocket wheel.

Once the roller chain has been repaired or replaced it becomes a simple matter to physically rotate the braking mechanism 10 in a clockwise direction to bring the follower roller 34 above the new or repaired and taut roller chain 24 so as to create the initially described engagement as shown in FIG. 1.

The invention has been shown and described by way of a presently preferred embodiment, and many variations and modifications maybe made therein without departing from the spirit of the invention. The invention, therefore, is not to be limited to any specified form or embodiment, except insofar as such limitations are expressly set forth in the claims.

What is claim is:

1. Automatic braking mechanism for a rolling door system having a support shaft for selectively rolling up or lowering a rolling door formed of a series of connected slats, a driven wheel on the support shaft, a motor drive for driving a drive wheel and a continuous loop drive coupling said drive and driven wheels and normally moving along a predetermined path prior to failure when said loop is under tension in a drive plane generally normal to said support shaft, said braking mechanism comprising an elongate sensing arm pivotally mounted at one end and carrying a follower at the other end normally indirect contact with said loop drive, said sensing arm being movable within a plane substantially parallel with said drive plane to arrange said follower in said drive plane for movements from one side of said predetermined path to at least partially bridge or cross said predetermined path to the other side thereof, an elongate actuator arm pivotally mounted for sharing common angular movements with said elongate sensing arm about a common pivot point; stop means mounted on said actuator arm for sharing pivotal movements with said actuator arm for movements between a normal mode disengaged position in which said stop means clears said drive wheel to permit rotation thereof when said follower engages said loop drive while said loop drive is under tension and a failure mode position in which said stop means engages said driven wheel to prevent rotation thereof when said follower bridges said predetermined path; and biasing means for normally urging said actuator arm to move to a failure mode position, whereby said loop drive maintains said arms in said normal positions prior to failure.

2. Automatic braking mechanism as defined in claim 1, wherein said sensing and actuator arms are integrally formed.

3. Automatic braking mechanism as defined in claim 1, wherein said sensing and actuator arms are joined at a vertex at which said arms are pivotally mounted.

4. Automatic braking mechanism as defined in claim 3, wherein said arms define an angle $\alpha$ therebetween at said vertex.

5. Automatic braking mechanism as defined in claim 4, wherein $\alpha \leqq 90°$.

6. Automatic braking mechanism as defined in claim 5, wherein said predetermined path of said loop drive defines an enclosed region prior to failure of said loop drive, and wherein said arms are pivoted at a point outside of said enclosed region.

7. Automatic braking mechanism as defined in claim 4, wherein said predetermined path of said loop drive defines an enclosed region prior to failure of said loop drive, and wherein said arms are pivoted at a point inside said enclosed region.

8. Automatic braking mechanism as defined in claim 1, wherein said follower comprises a roller mounted at said other end of said sensing arms.

9. Automatic braking mechanism as defined in claim 1, wherein said drive and driven wheels are sprocket wheels and said loop drive comprises a roller chain.

10. Automatic braking mechanism as defined in claim 9, wherein said stop means comprises at least one transverse pin mounted on said actuator arm along a direction substantially parallel to said support shaft and each dimensioned to be received between two sprocket teeth of said driven sprocket wheel.

11. Automatic braking mechanism as defined in claim 1, wherein said biasing means comprises at least one tension spring connected between a fixed reference point and said actuator arm.

12. Automatic braking mechanism as defined in claim 1, wherein said stop means is mounted on said actuator arm at a position intermediate to said pivoted end and an opposing free end.

13. Automatic braking mechanism as defined in claim 12, wherein said biasing means is coupled to said opposing free end of said actuator arm to maximize the restoring torque on said actuator arm to restore the same to said failure engaged position.

14. Automatic braking mechanism as defined in claim 12, wherein the distance between the pivoted end of said sensing arm and said follower normally engaged with said loop drive is $d_1$, the distance between the pivoted end of said follower arms and said intermediate position where said stop means is supported is $d_2$ and wherein $d_1 \neq d_2$.

15. Automatic braking mechanism as defined in claim 14, wherein $d_2 > d_1$.

16. Automatic braking mechanism as defined in claim 15, wherein $d_2 d_1 \geqq 1.25$.

17. Automatic braking mechanism as defined in claim 16, wherein $d_2 d_1 \approx 1.40$.

18. Automatic braking mechanism as defined in claim 1, further comprising retaining means for retaining said stop means in locking engagement with said driven wheel after said loop drive has failed to assure that said driven wheel cannot inadvertently rotate following failure.

19. Automatic braking mechanism as defined in claim 18, wherein said retaining means comprises a pawl pivotably mounted proximate to said actuator arm and maintained by said actuator arm in a non-operative position against the action of a biasing spring; and a stop pin for limiting movement of said pawl beyond a dead center actuator arm has moved into engagement with said driven wheel in which said pawl abuts against said actuator arm and prevents pivotal movements thereof.

20. Automatic braking mechanism for a rolling door system having a support shaft for selectively rolling up or lowering a rolling door formed of a series of connected slats, a driven wheel on the support shaft, a motor drive for driving a drive wheel and a continuous loop drive coupling said drive and driven wheels and normally moving along a predetermined path prior to failure when said loop is under tension in a drive plane generally normal to said support shaft, said braking mechanism comprising an elongate sensing arm pivotally mounted at one end and carrying a follower at the other end normally indirect contact with said loop drive, said sensing arm being movable within a plane substantially parallel with said drive plane to arrange said follower in said drive plane for movements from one side of said predetermined path to at least partially bridge or cross said predetermined path to the other side thereof, an elongate actuator arm unitary with said sensing arm and sharing common angular movements with said elongate sensing arm; stop means associated with said actuator arm for movements between a normal mode disengaged position in which said stop means clears said drive wheel to permit rotation thereof when said follower engages said loop drive while said loop drive is under tension and a failure mode position in which said stop means engages said driven wheel to prevent rotation thereof when said follower bridges said predetermined path; and biasing means for normally urging said actuator arm to move to a failure mode position, whereby said loop drive maintains said arm in said normal positions prior to failure.

21. Automatic braking mechanism for a rolling door system having a support shaft for selectively rolling up or lowering a rolling door formed of a series of connected slats, a driven wheel on the support shaft, a motor drive for driving a drive wheel and a continuous loop drive coupling said drive and driven wheels and normally moving along a predetermined path prior to failure when said loop is under tension in a drive plane generally normal to said support shaft, said braking mechanism comprising an elongate sensing arm pivotally mounted at one end and carrying a follower to the other end normally in direct contact with said loop drive, said sensing arm being movable within a plane substantially parallel with said drive plane to arrange said follower in said drive plane for movements from one side of said predetermined path to at least partially bridge or cross said predetermined path to the other side thereof, an elongate actuator arm pivotally mounted for sharing common angular movements with said elongate sensing arm; stop pin mounted on said actuator arm for sharing pivotal movements with said actuator arm for movements between a normal mode disengaged position in which said pin clears said drive wheel to permit rotation thereof when said follower engages said loop drive while said loop drive is under tension and a failure mode position in which said stop means engages said driven wheel to prevent rotation thereof when said follower bridges said predetermined path; and biasing means for normally urging said actuator arm to move to a failure mode position, whereby said loop drive maintains said arms in said normal positions prior to failure.

* * * * *